US007517264B2

(12) United States Patent
Carr

(10) Patent No.: US 7,517,264 B2
(45) **Date of Patent: *Apr. 14, 2009**

(54) POWER BOAT DRIVE SYSTEM WITH MULTIPLE GEARBOXES

(75) Inventor: Richard D. Carr, Destin, FL (US)

(73) Assignee: Geared Up Systems, Inc., Destin, FL (US)

( * ) Notice: Subject to any disclaimer, the term of this patent is extended or adjusted under 35 U.S.C. 154(b) by 437 days.

This patent is subject to a terminal disclaimer.

(21) Appl. No.: 11/059,284

(22) Filed: Feb. 16, 2005

(65) Prior Publication Data

US 2006/0089062 A1 Apr. 27, 2006

Related U.S. Application Data

(60) Provisional application No. 60/622,386, filed on Oct. 27, 2004.

(51) Int. Cl.

| | |
|---|---|
| ***B63H 5/08*** | (2006.01) |
| ***B63H 21/38*** | (2006.01) |
| ***B63H 23/06*** | (2006.01) |
| ***F16H 57/02*** | (2006.01) |
| ***F16H 57/04*** | (2006.01) |

(52) U.S. Cl. ..... 440/75; 440/79; 440/111; 74/606 A

(58) Field of Classification Search ..... 440/75, 440/79, 82, 83, 111, 112; 74/606 A; 184/6.22, 184/104.1, 104.3

See application file for complete search history.

(56) References Cited

U.S. PATENT DOCUMENTS

| | | | | |
|---|---|---|---|---|
| 809,064 A | | 1/1906 | Johnson | |
| 1,359,150 A | | 11/1920 | Boehm | |
| 1,999,912 A | | 4/1935 | McPartland | |
| 2,386,362 A | | 10/1945 | Soldner | |
| 2,936,730 A | * | 5/1960 | Patty, Jr. | 440/56 |
| 3,112,728 A | | 12/1963 | Krause | |
| 3,113,549 A | * | 12/1963 | Frank et al. | 440/62 |
| 3,128,742 A | | 4/1964 | Cameron | |
| 3,261,229 A | * | 7/1966 | Thomas et al. | 74/665 GB |
| 3,376,842 A | | 4/1968 | Wynne | |

(Continued)

FOREIGN PATENT DOCUMENTS

JP 08040369 A * 2/1996

*Primary Examiner*—Ajay Vasudeva
(74) *Attorney, Agent, or Firm*—Polster, Lieder, Woodruff & Lucchesi, L.C.

(57) ABSTRACT

A boat drive system is provided for a power boat which includes an engine having a drive shaft, connected to a pair of propeller shafts. The drive system includes a primary gearbox and opposed outboard gearboxes. The primary gearbox includes a housing and a gear arrangement connected to the engine shaft and the outboard gearboxes, which are connected to the primary gearbox by a transverse shaft, include a housing and a gear arrangement connected to associated propeller shafts. A cooling system is provided including a cooling pad for each gearbox. A support system is provided for each outboard gearbox including a cradle connected to the bearing points on the hull. The engine includes an adapter plate attached to the primary gearbox for movement of the primary gearbox with the engine. In a modified drive system only one outboard gearbox is used in conjunction with a single engine. In another modified drive system a single engine and propeller are used in conjunction with a gearbox having a take-off shaft.

19 Claims, 14 Drawing Sheets

U.S. PATENT DOCUMENTS 3,422,789 A 1/1969 Wynne et al.
3,422,790 A * 1/1969 Connell ..... 440/4
3,515,087 A 6/1970 Stuart
3,611,973 A 10/1971 Stuart
3,628,485 A 12/1971 Gill et al.
3,871,325 A * 3/1975 Raulerson ..... 440/57
3,922,997 A 12/1975 Jameson
4,344,760 A * 8/1982 Kulikowski ..... 440/3
4,351,635 A * 9/1982 Staedeli ..... 440/75
4,383,828 A 5/1983 Wynne
4,428,734 A * 1/1984 Ludlow ..... 440/75
6,066,012 A * 5/2000 Nagle ..... 440/75
7,442,103 B1 * 10/2008 Carr ..... 440/75

* cited by examiner

POWER BOAT DRIVE SYSTEM WITH MULTIPLE GEARBOXES

CROSS REFERENCE TO RELATED APPLICATIONS

U.S. Provisional Application No. 60/622,386, filed Oct. 27, 2004.

BACKGROUND OF THE INVENTION

This invention relates generally to a power boat drive system and particularly to a drive system having a superior cooling arrangement.

The invention is adaptable for use with a single engine boat having a transverse drive shaft connected to twin propeller shafts. Power boats having a single engine, and twin propeller shafts are not in themselves new and are disclosed in U.S. Pat. No. 3,112,728 (Krause), U.S. Pat. No. 3,113,549 (Frank et. al), U.S. Pat. No. 3,128,742 (Cameron), U.S. Pat. No. 4,428,734 (Ludlow) and U.S. Pat. No. 6,066,012 (Nagle) which are incorporated herein by reference. Such boats have not been particularly successfully owing partly to the inadequate cooling of the drive gears and complicated mounts for the drive system.

This twin drive cooling system solves these and other problems in a manner not disclosed by the known prior art.

SUMMARY OF THE INVENTION

This invention provides a drive system for a power boat powered by a single engine having a primary gearbox and opposed, outboard gearboxes, all gearboxes, being cooled by the cooling pads connected to the gearboxes. A cushioned cradle drive support system facilitates the placement of the engine and the drive system.

This drive system is for a power boat which includes an engine having a drive shaft, connected to a pair of propeller shafts. The drive system includes a primary gearbox and oppositely located outboard gearboxes. The primary gearbox includes a housing and a gear arrangement connected to the engine shaft and the outboard gearboxes are operatively connected to the primary gearbox, each gearbox including, a housing and a gear arrangement connected to associated propeller shafts through a marine transmission. A cooling system is provided including a cooling pad for each gearbox.

This three gear, split shaft balanced arrangement increases the torque capacity of the propeller shafts measurably and to almost twice that of a continuous lateral drive shaft. In the embodiment shown a marine transmission is provided between each outboard gearbox and its associated gear propeller shaft and the direction of rotation of the propeller depends on the direction required by the marine transmission.

A support system may be provided for each outboard gearbox including a cradle connected to bearing points on the hull. The engine includes an adapter plate attached to the primary gearbox for movement of the primary gearbox together with the engine.

A modified two gearbox power boat drive system may be provided in which only one outboard gearbox is used in conjunction with a single engine with a gearbox and the engine drive shaft is coupled to an associated propeller shaft.

This modified arrangement can be used with much narrow power boats, for example with boats having twin drive propellers as close as thirty-four inches as opposed to fifty-four inches with the power boat drive system described in the previous embodiment. There are other advantages. For example, dispensing with one gearbox and its lateral drive shaft saves considerable weight, up to one hundred pounds, resulting in a savings in cost of approximately one-third over the system previously described. And this advantage is achieved with relatively small power loss.

Other advantages are also available including power take-off from the opposite side of the engine or from the single gearbox, which, in addition, provides the power for running hydraulic systems, fire pumps, water pumps or connected directly into a clutch for independent usage from single outboard gearbox. In general, power take-off is available any time the engine is running.

The single engine can be mounted on either side of the power boat, i.e. port or starboard of the driven gearbox which, depending on the selection of the gear arrangement, will turn the direction of the engine in the same or the reverse direction.

While the length of the engine room is increased, and the engine must be mounted off-center, this can be compensated for by counterbalancing or by moving the center of gravity of the drive system closer to the centerline of the boat. Shaft alignment may also become more critical as the transverse shaft length is increased but this disadvantage is more than compensated for by the advantages set forth above.

In another modified drive system a single engine and propeller are used in conjunction with a gearbox having a take-off shaft.

DESCRIPTION OF THE PREFERRED EMBODIMENTS

Figure 1:
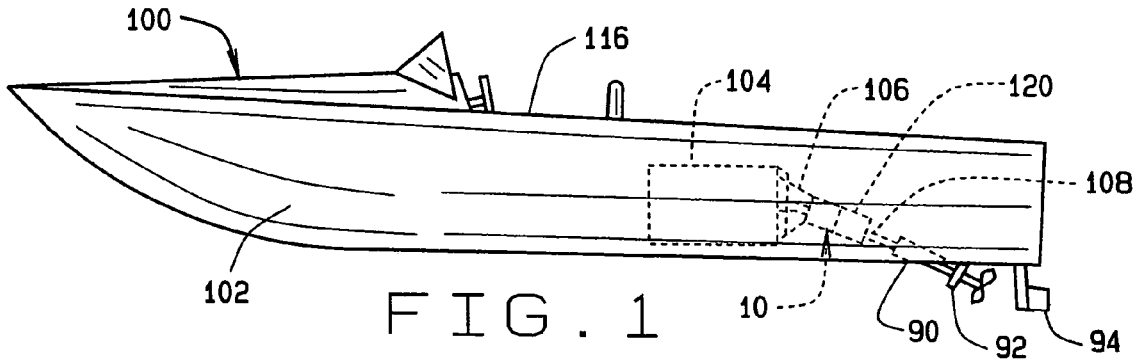
FIG. 1 is an elevational view of a power boat with the single, engine, twin screw system having the engine mounted in a forward position.
Figure 2:
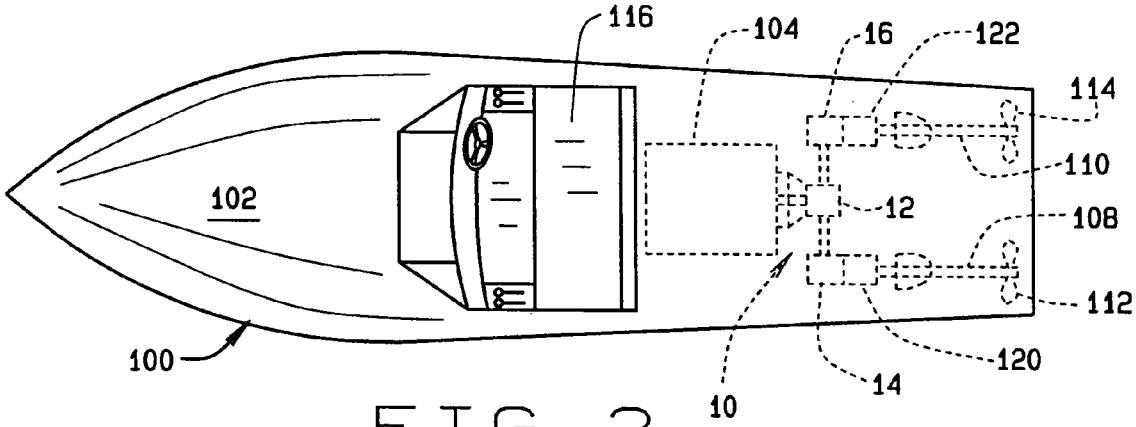
FIG. 2 is a plan view of the power boat of FIG. 1
Figure 3:
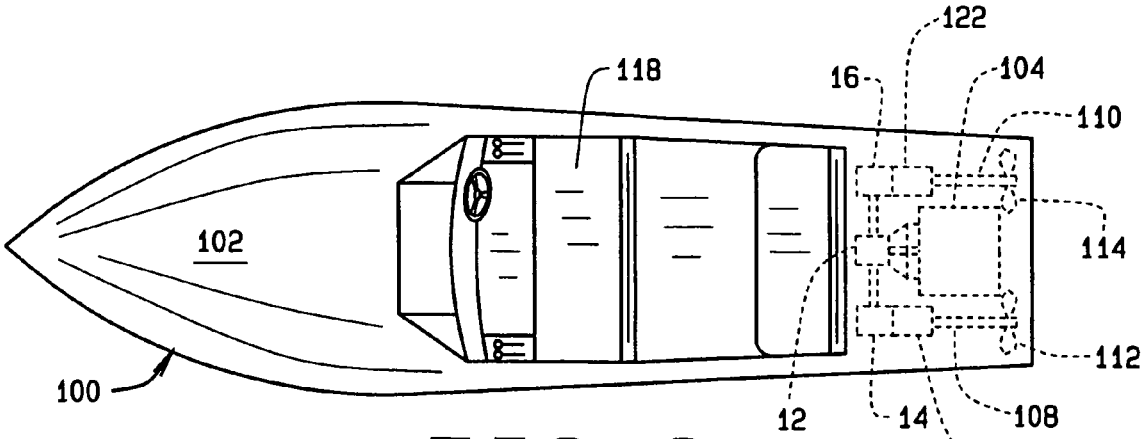
FIG. 3 is a similar view to FIG. 1 with the engine mounted astern.
Figure 4:
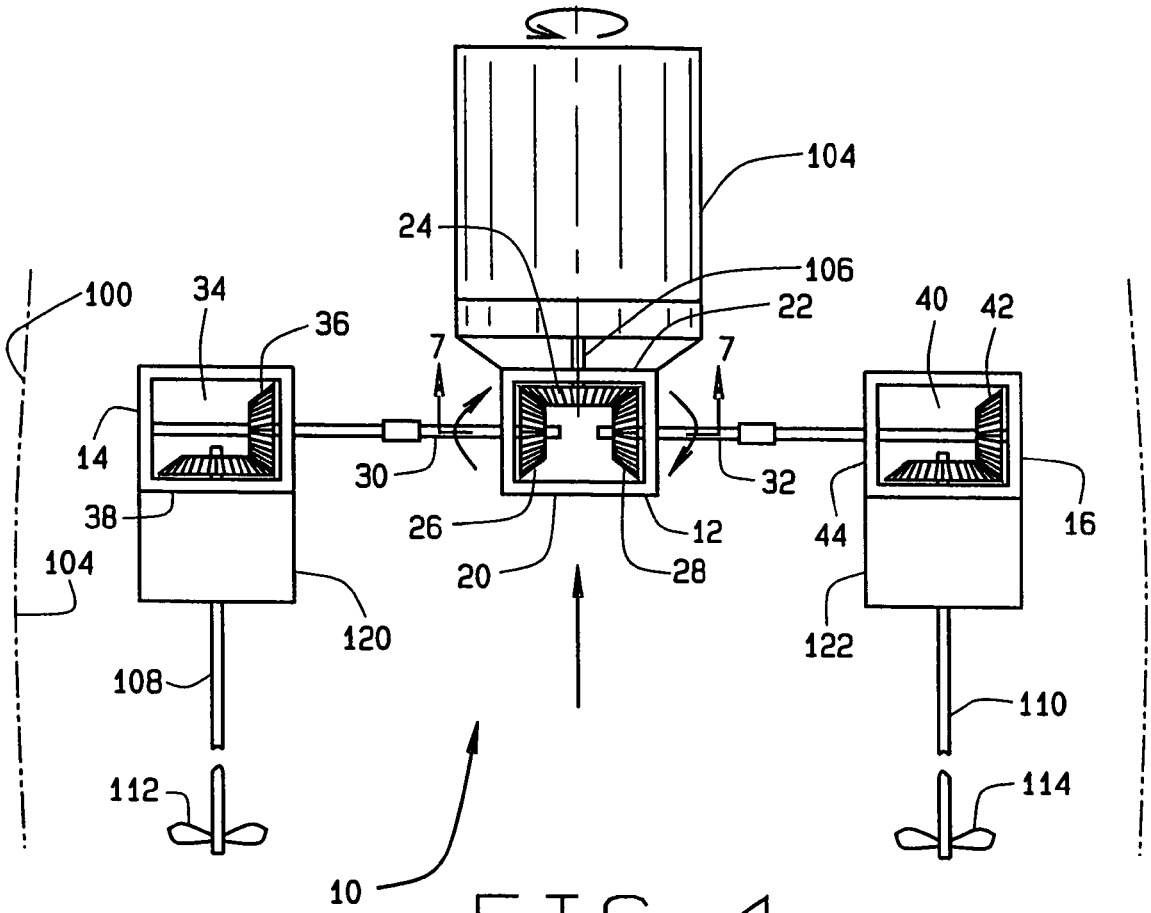
FIG. 4 is a schematic view of the power boat drive system with the engine in a forwardly mounted position.
Figure 5:
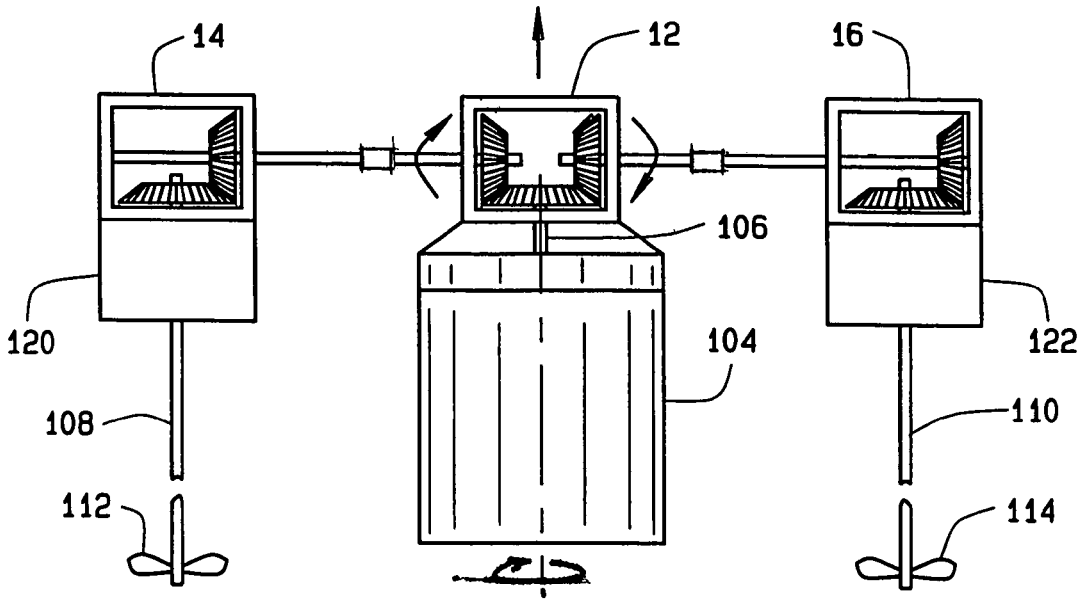
FIG. 5 is a similar view to FIG. 4 with the engine shown in a rearwardly mounted position.

Referring now by reference numerals to the drawings and first to FIGS. 1-7 it will be understood that the drive system generally indicated by numeral 10 is used for a boat, such as the power boat indicated by numeral 100. In the embodiment shown the power boat 100 includes a hull 102, an engine 104, having a drive shaft 106; a pair of generally parallel, laterally spaced propeller shafts 108 and 110 having propellers 112 and 114, respectively.

Figure 8:
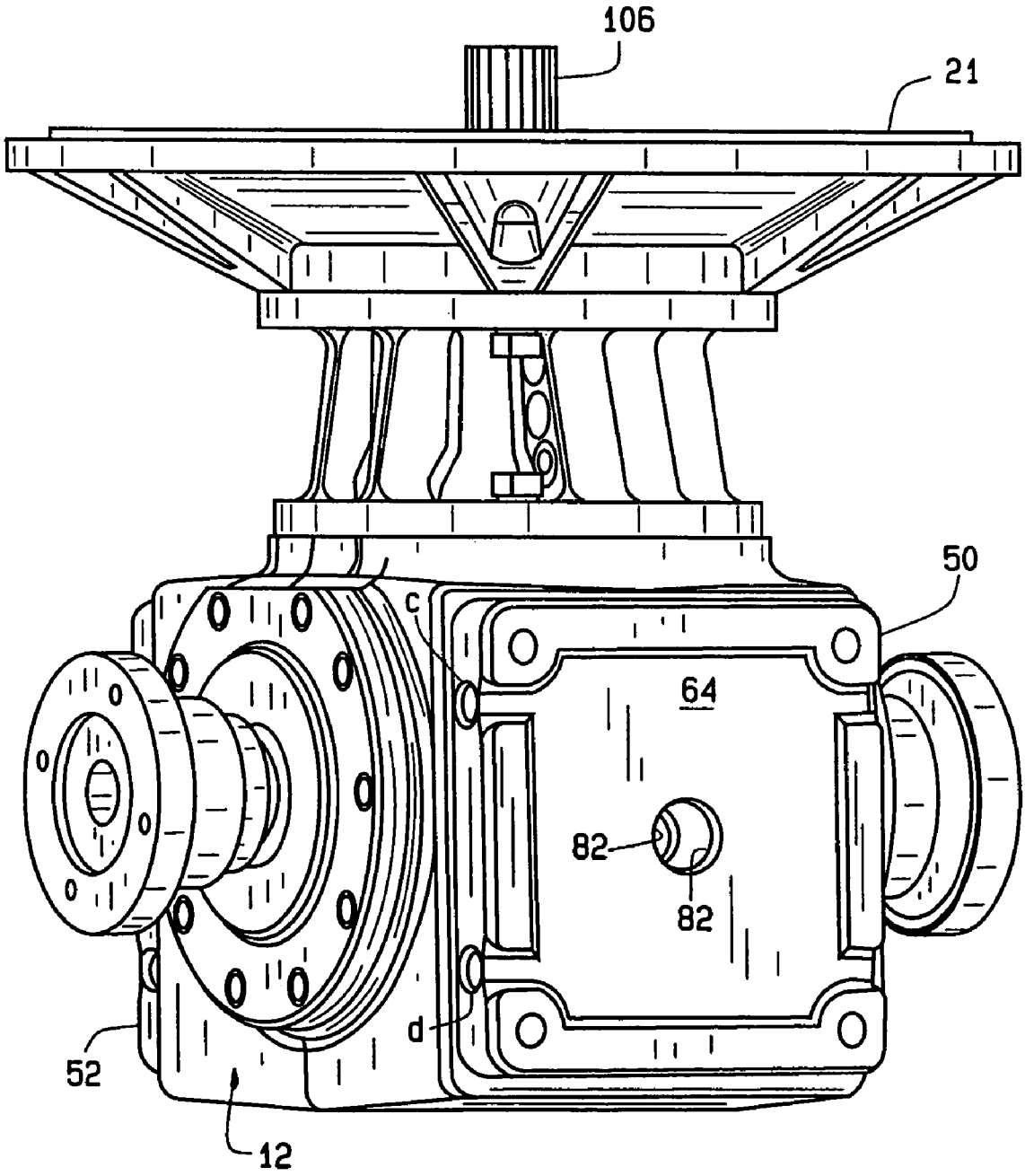
FIG. 8 is a perspective view of the main gear box.

The drive system 10 includes a primary gearbox 12 and opposed outboard gearboxes 14 and 16. The primary gearbox 12 includes a housing 20 having a U-configuration gear arrangement 22 therewithin including a bevel gear 24, attached to the engine drive shaft 106 and bevel gears 26 and 28 attached to associated elongated split shafts 30 and 32, respectively, extending between the primary gearbox 12 and outboard gearboxes 14 and 16 respectively. It will be observed that an engine adapter plate 21 facilitates the attachment of the primary gearbox 12 to the engine 104 as best shown in FIG. 8.

The port side outboard gear box 14 includes an L-configuration gear arrangement 34 therewithin including a bevel gear 36 attached to the split shaft 30 and a bevel gear 38 attached to the propeller shaft 108 through a marine transmission. The starboard side outboard gearbox 16 also includes an L-configuration gear arrangement 40 therewithin including a bevel gear 42 attached to the split shaft 32 and a bevel gear 44 attached to the propeller shaft 110 through a marine transmission. In the preferred embodiment, as shown in FIG. 1, each propeller shaft exits the floor of the hull 102 rather than the end and includes, a conventional stuffing box 90 and holding strut 92 forward of the rudder 94.

The drive system 10, described above in simplified terms, has considerable versatility. It permits, for example, the engine 104 to be disposed forward, aft or off-centerline. The engine can be mounted level regardless of the angle of the propeller shafts 108 and 110 to keep the floor of the boat 100 as low as possible, resulting in less interference in determining the optimum angle of the propeller shafts. The versatility of the drive system is enhanced considerably by the flat frusto-conical adapter plate 21, which is fixedly attached to the primary gearbox 12 at its small end, as by bolting, and fixedly attached to the engine 104 at its large end as by bolting.

Figure 13:
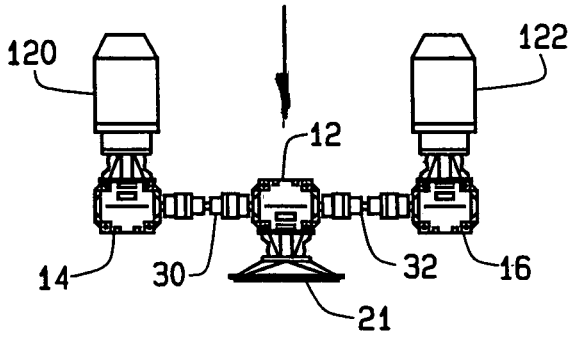
FIG. 13 is a reduced size plan view of the drive system with the engine in a forward position.
Figure 14:
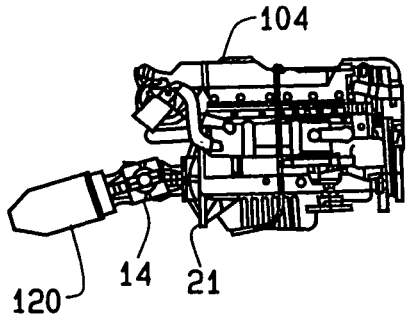
FIG. 14 is a side view of the drive system shown in FIG. 13

In general, the arrangement of the drive system 10 permits three basic configurations of the system, as shown in FIGS. 13-18 the first configuration is the conventional in-board installation shown in FIGS. 13 and 14. This is the engine forward design in which the engine output is mounted toward the stern in front of the drive system 10. This configuration utilizes marine transmissions 120 and 122.

Figure 15:
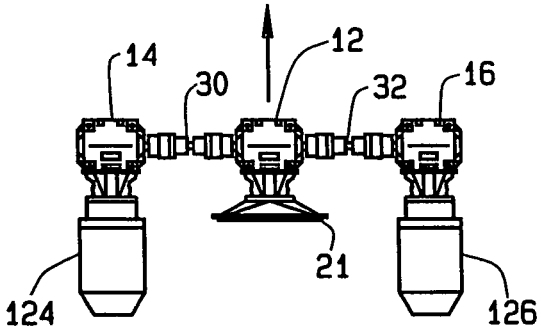
FIG. 15 is a reduced size plan view of the drive system with the engine in the stern position.
Figure 16:
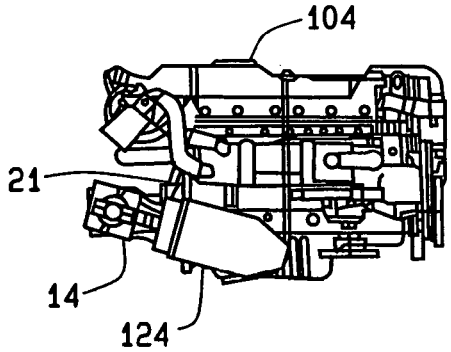
FIG. 16 is a side view of the drive system shown in FIG. 15.

The second configuration is the Vee Drive shown in FIGS. 15 and 16. This configuration is suitable when the boat design requires the engine 104 to be mounted farther astern and allows the engine to be mounted behind and alongside the drive system 10. This configuration also utilizes marine transmissions 124 and 126.

Figure 17:
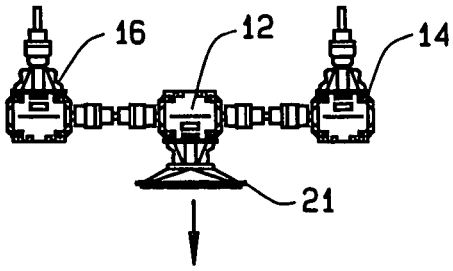
FIG. 17 is a reduced size plan view of the drive system utilizing a jackshaft.
Figure 18:
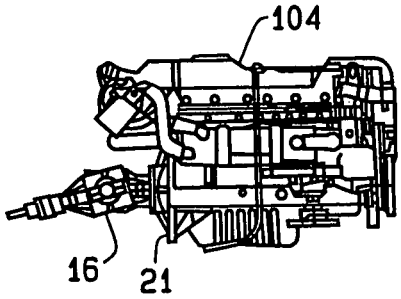
FIG. 18 is a side view of the drive system shown in FIG. 17.

Third is the Jack Shaft Output which is shown in FIGS. 17 and 18 and is used when it is desired to provide power to outdrives. The jack shaft arrangement may be used in either conventional or Vee Drive configurations.

Importantly, the drive system 10 described herein is preferably manufactured with a replaceable water cooling system. In the embodiment shown the cooling liquid is water. The raw water is tapped from the engine 104 cooling source and never comes into direct contact with the gear arrangements. This unique and efficient cooling water system will now be described with reference to FIGS. 6-12.

Figure 6:
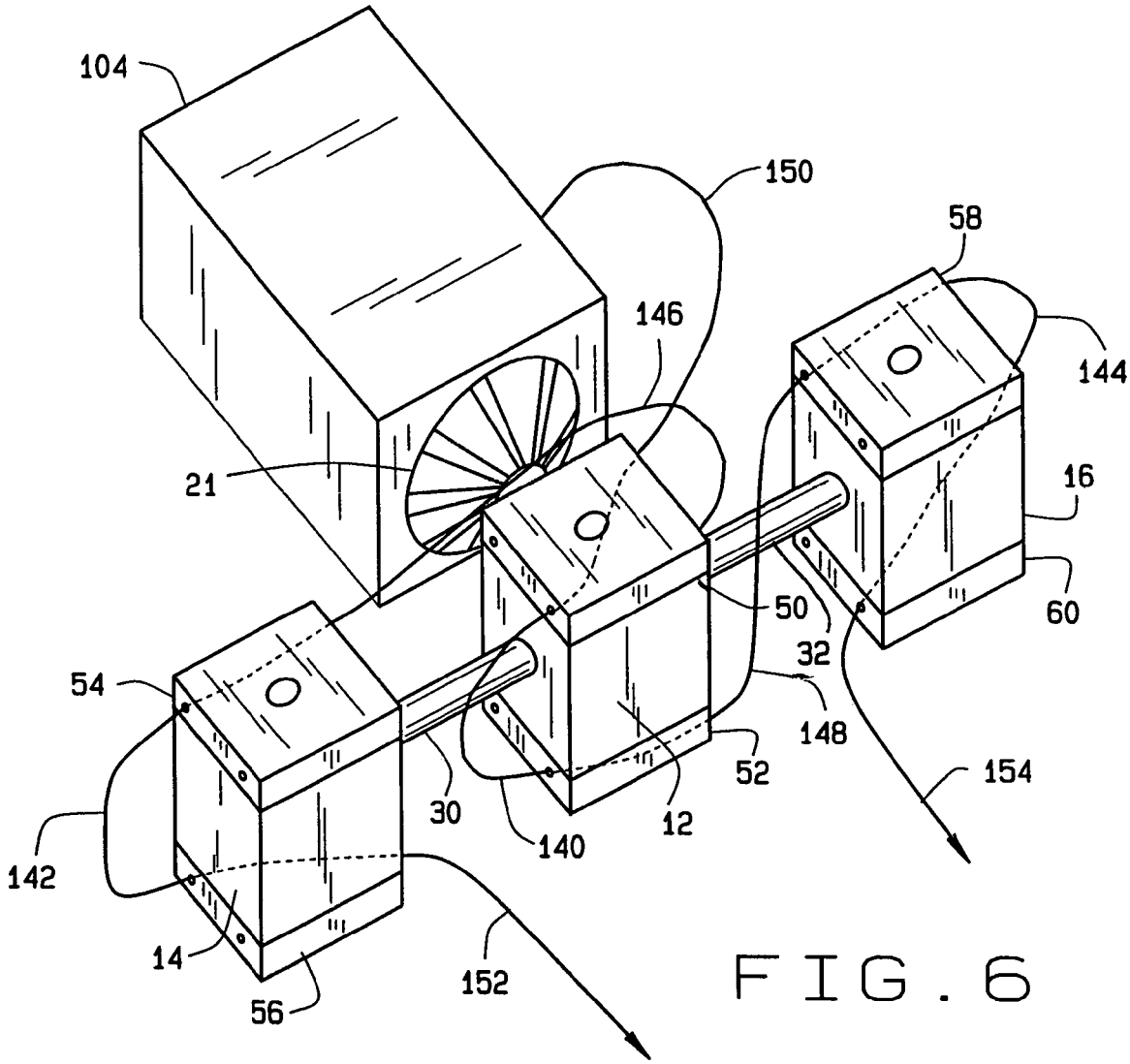
FIG. 6 is a simplified diagram showing the cooling system.

As shown in FIG. 6, each of the three gearboxes, the primary gearbox 12 and the outboard gearboxes 14 and 16 includes opposed pairs of upper and lower cooling pads, 50 and 52 for the primary gearbox 12; 54 and 56 for the port gearbox 14 and 58 and 60 for the starboard gearbox 16. Since the gearboxes 12, 14, and 16 are cooled in substantially the same manner it is sufficient to describe the primary gearbox 12 and cooling pads 50 and 52 in detail.

Figure 7:
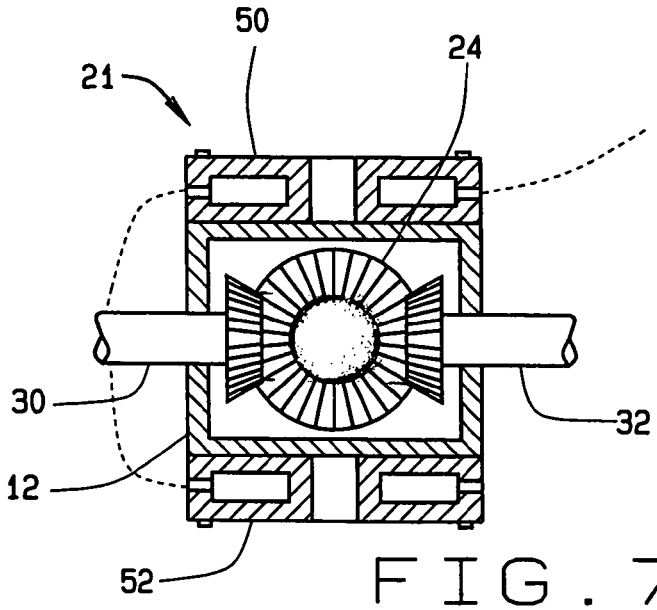
FIG. 7 is a cross sectional view of the primary gearbox taken on line 7-7 of FIG. 4 with the cooling pads installed.

The cooling pad 50, best shown in FIGS. 9-12, is typical in that it includes an upper wall 64, a lower wall 66, and opposed sidewalls 68, 70, and 72 74. In the embodiment shown the upper and lower walls 64 and 66 are connected by a generally cylindrical tapered wall 80 defining an access opening 82 for the gear box 12. This arrangement provides a hollow chamber around the wall 80. The opposed sidewalls 72 and 74 each include two passages a and b, and c and d respectively which provide for circulation of the cooling liquid from the engine 104 to each of the three upper and three lower cooling pads 50, 52; 54, 56 and 58, 60 as best shown in FIGS. 6 and 7. It will be understood that fastener bolt receiving openings are provided at each corner of each cooling pad to provide attachment to its associated gearbox by bolts 62 received into tapped holes in the gearbox. A layer of heat sink grease, a silicone compound, may be provided between each cooling pad and its associated gear box to facilitate heat transfer.

The cooling water is distributed to the upper and cooling pads 50, 52; 54, 56 and 56, 58 by means of inlet/outlet openings a, b, c and d and flexible conduits as shown in FIG. 6. To this end the upper and lower cooling pads are connected by loops. For example, upper and lower pads 50 and 52 are connected by hose 140 extending between openings 50*d* and 52*d*. Pads 54 and 56 are connected by conduit 142 extending between openings 54*c* and 56*c*. Pads 58 and 60 are connected by conduit 144 between opening 58*a* and 60*a*.

In order to complete the cooling distribution circuitry a flexible conduit 146 is connected between lower pad 52 and upper pad 54 by conduit 146 extending between openings 52*a* and 54*a* and conduit is connected between lower pad 52 and upper pad 58 extending between openings 52*b* and 56*c*. Cooling water is supplied from the engine 104 to upper cooling pad 50 by a flexible conduit 150 extending between an outlet from engine 104 and opening 50*a*. Finally, water is discharged from lower pad 56 by conduit 152 connected to opening 56*b* and directed to an overboard location, and by conduit 154 connected to opening 58*d* and also directed to an overboard location.

Figure 19:
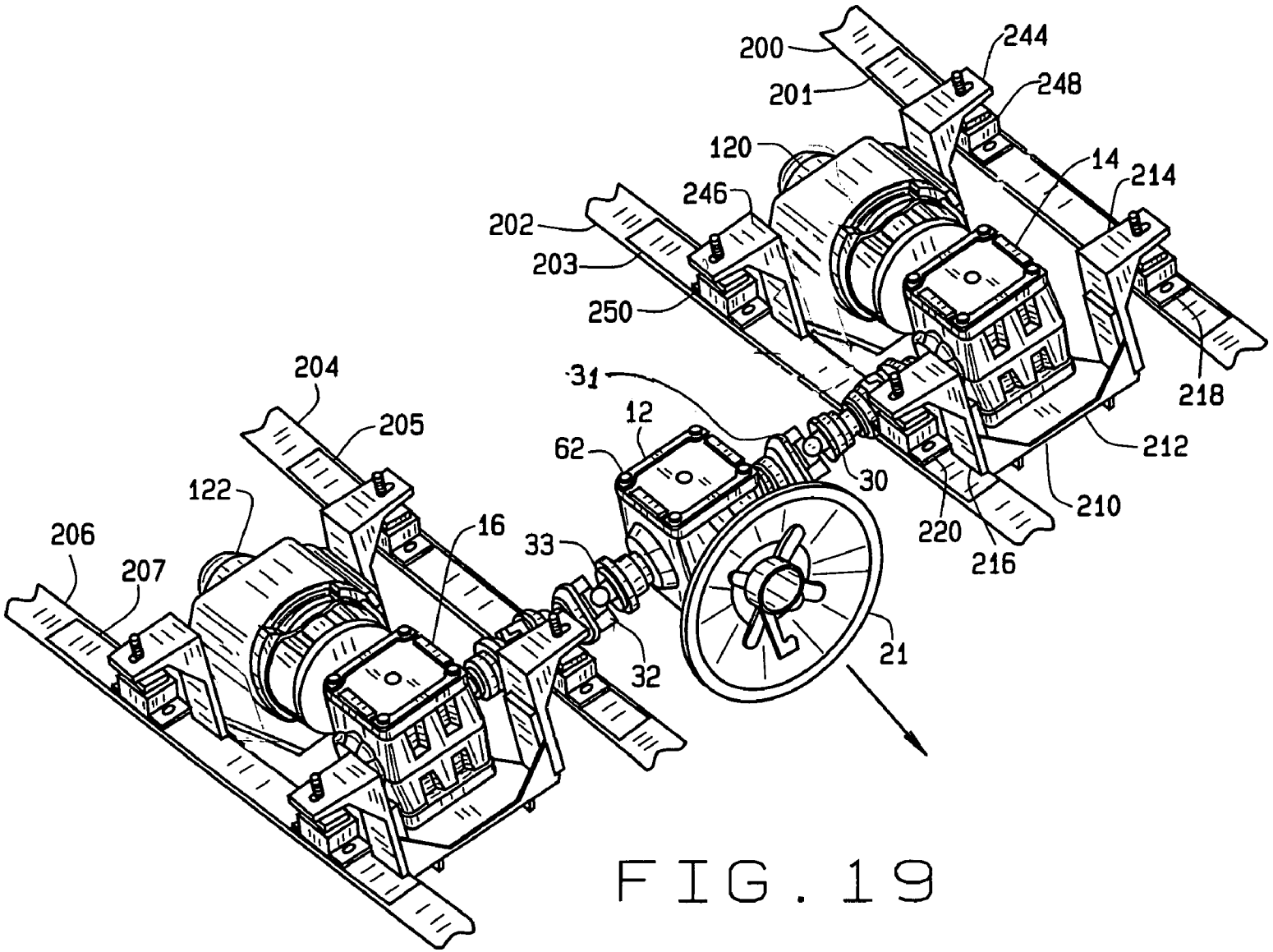
FIG. 19 is a perspective view of the support system.

A preferred mounting system for the drive system 10 is shown by reference to FIG. 19.

Essentially, the engine 104, the engine adapter 21 and the primary gearbox 12 mount as a single unit. The outboard port and starboard and gearboxes 14 and 16 respectively, and associated marine transmissions 120 and 122, where used, mount in alignment with the port and starboard propeller shafts 108 and 110 respectively.

The marine transmissions 120, 122 used in the boat drive systems, for example, marine transmissions 120 and 122, are standard transmissions as manufactured by Hurth/ZF a European firm with offices located in Florida such as transmission No. 63A. Such transmissions are well-known to those skilled in the art.

The primary gearbox 12 and the port and starboard outboard gearboxes 14 and 16 are connected with the flexible shafts 30 and 32 having universal joints 31 and 33 the joints; allowing for engine torque within the mount and misalignment between the primary and outboard drives. Propeller thrust may be terminated into the final drive component or a thrust plate arrangement that terminates into the stringer system of the boat.

As shown in FIG. 19 the longitudinally extending boat stringers 200, 202, 204 and 206, preferably provided with bearing plates 201, 203, 205 and 207 respectively, provide a support system. The outboard gearboxes 14 and 16 are similar and the support system will be described with respect to the portside arrangement only.

The primary gearbox 12, complete with upper and lower cooling pads, is mounted directly to the engine 104 by the adapter plate 21 and is carried by said engine which is bolted to the boat hull in the conventional way.

Figure 20:
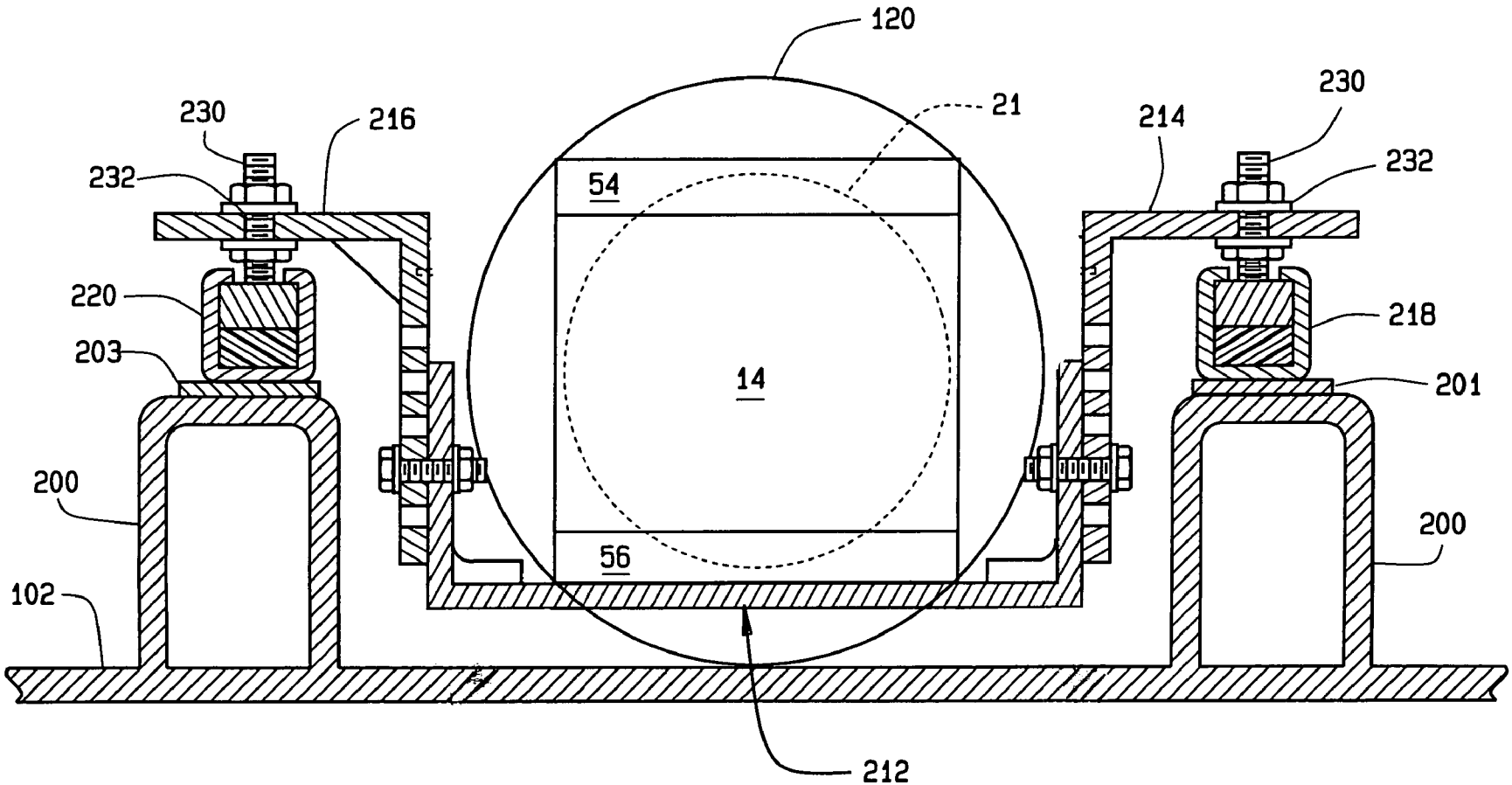
FIG. 20 is an enlarged view of the cradle cushion blocks.

As shown by reference to FIGS. 19 and 20, the portside gearbox 14, complete with upper and lower cooling pads, is carried by a cradle 210 which is slung between stringer bearing plates 201 and 203. The cradle 210 includes a generally U-shaped intermediate seat portion 212 and generally ell-shaped end portions 214 and 216 adjustably attached to the arms of the seat 212 to provide coarse vertical adjustment for the cradle 210. The cradle 210 is carried by mounting blocks 218 and 220 which are bolted respectively to the stringer base plates 201 and 203 of stringers 200 and 202. As best shown in FIG. 20 the mounting block 220 includes a recess receiving the lower end of a cushioned bolt 230. The upper end of the bolt 230 is received by a slot 232 in the horizontal leg of the end portions 214 and 216.

The portside marine transmission 120 is bolted to angle brackets 244 and 246 connected respectively to mounting blocks 248 and 250 bolted respectively to the stringer base plate 201 and 203. The mounting blocks 248 and 250 include cushioned bolts 62 and are substantially as described above and having a threaded shank received by a slot in the horizontal legs of brackets 244 and 246 to provide adjustment.

The installation of drive can be accomplished as follows:

1. mount the propeller shafts, marine transmissions 120 and 122 and outboard drive gearbox components in line;
2. mount the engine 104 and primary gearbox 12 conventionally using engine mounts to split the runout on each side;

It will be understood that, the drive gear arrangement, cooling arrangement and the drive support arrangement described have been very effective for the intended purpose. However, it will be understood by those skilled in the art that other components and arrangements may be used to provide satisfactory results. Accordingly, although the power boat drive system has been described by making detailed reference to preferred embodiments, such details of description are not to be understood as restrictive, numerous variants being possible within the scope of the claims hereunto appended.

Figure 10:
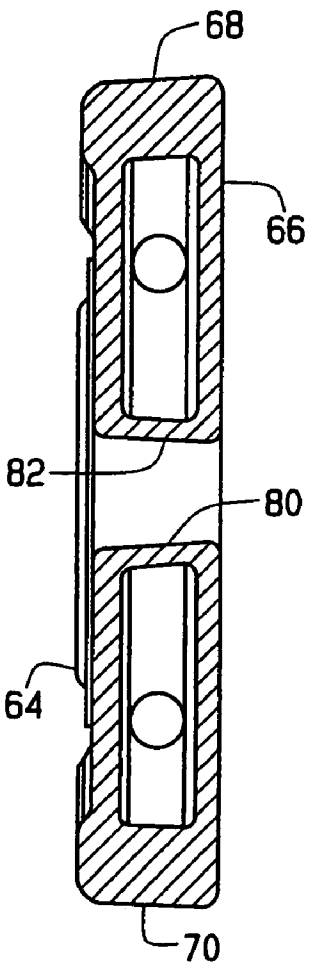
FIG. 10 is a cross-sectional view taken on line 10-10 of FIG. 9.
Figure 9:
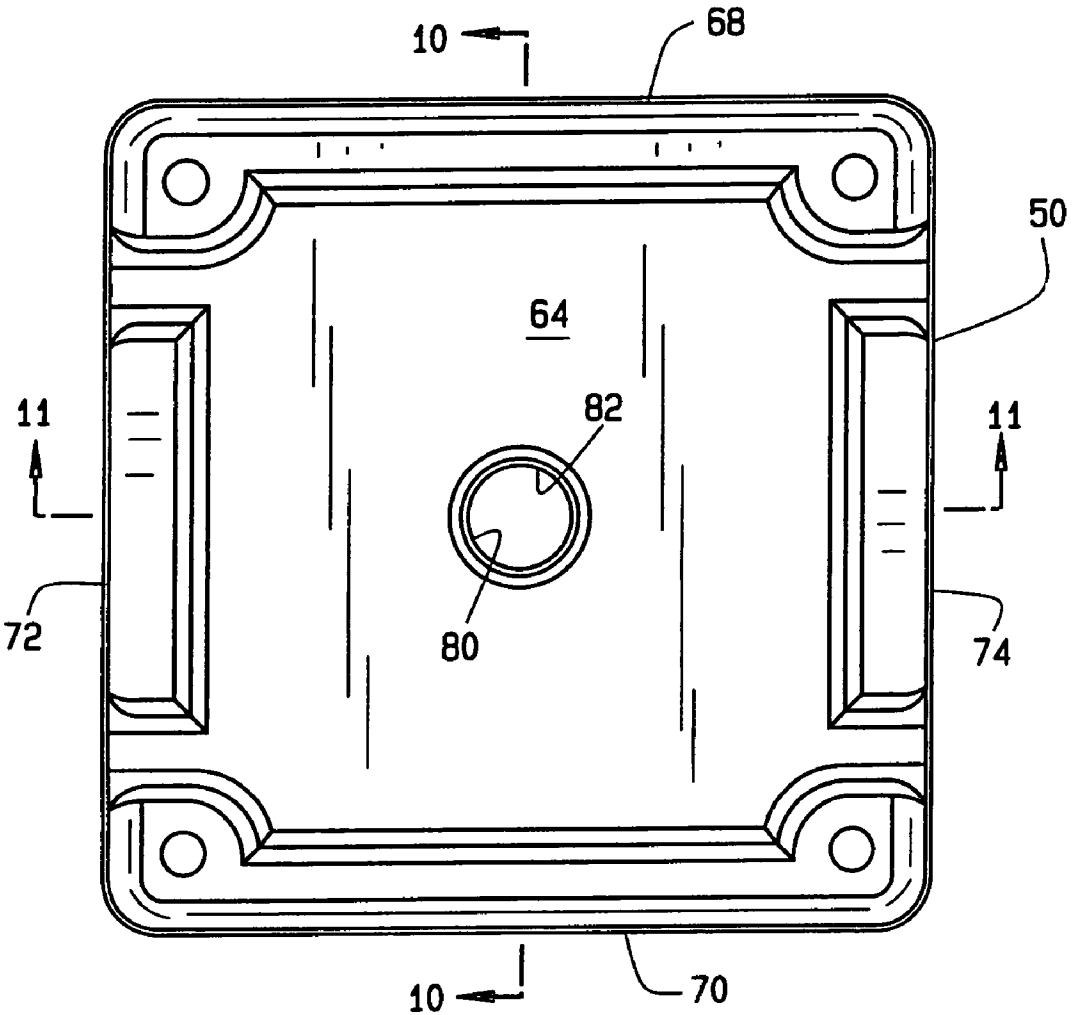
FIG. 9 is a plan view of the main gear box cooling pad.
Figure 11:
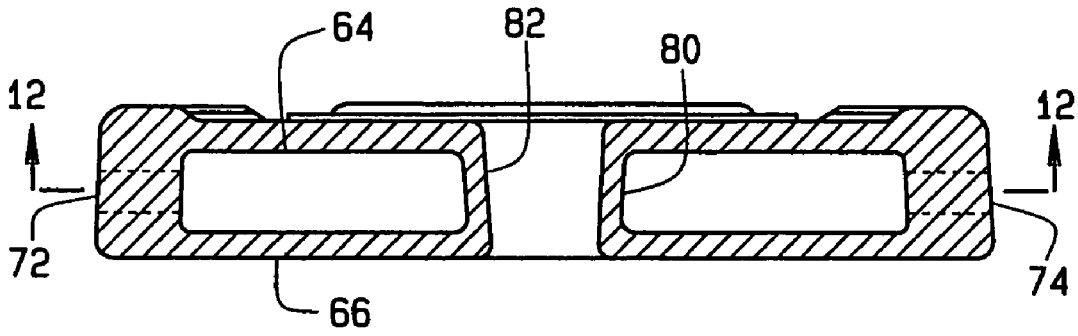
FIG. 11 is a cross-sectional view taken on line 11-11 of FIG. 10.
Figure 12:
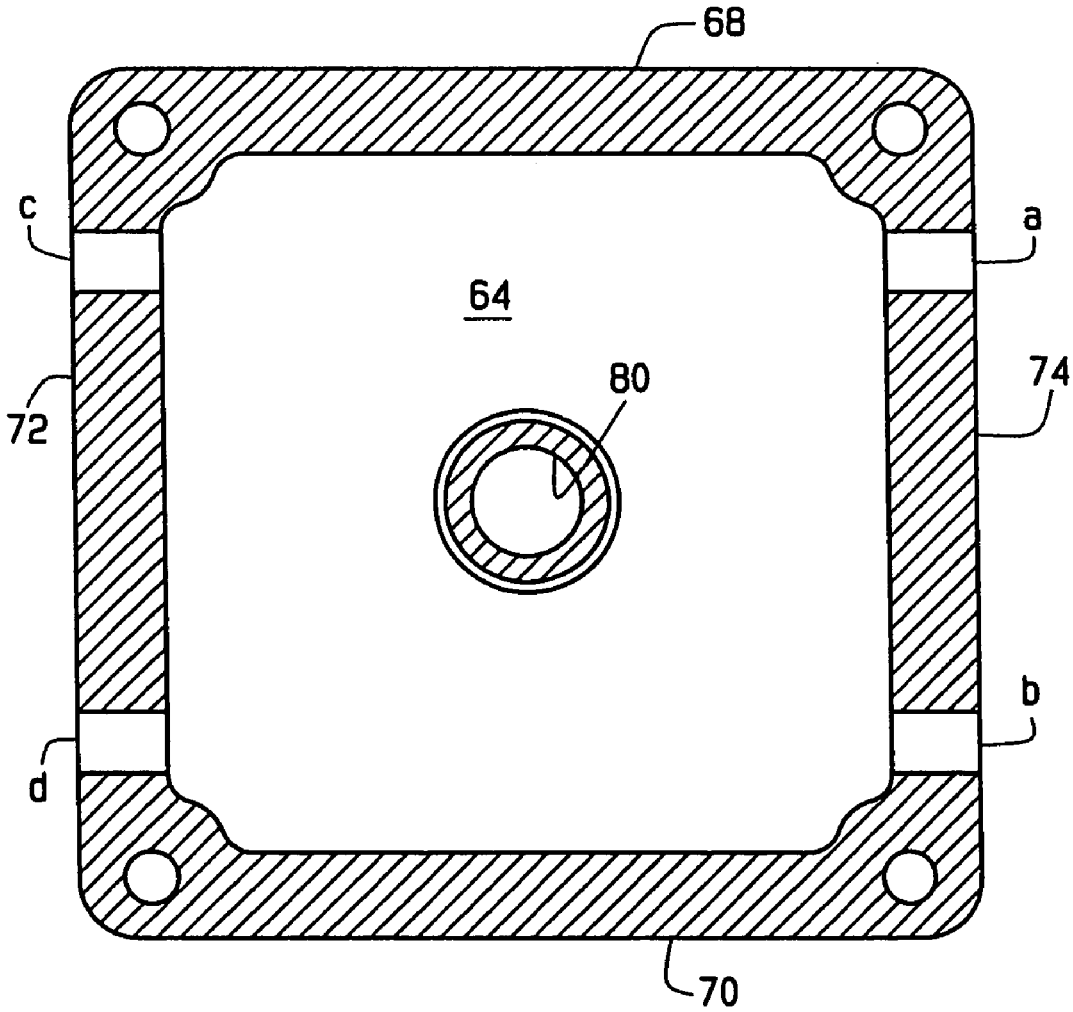
FIG. 12 is a cross-sectional view taken on line 12-12 of FIG. 11.
Figure 21:
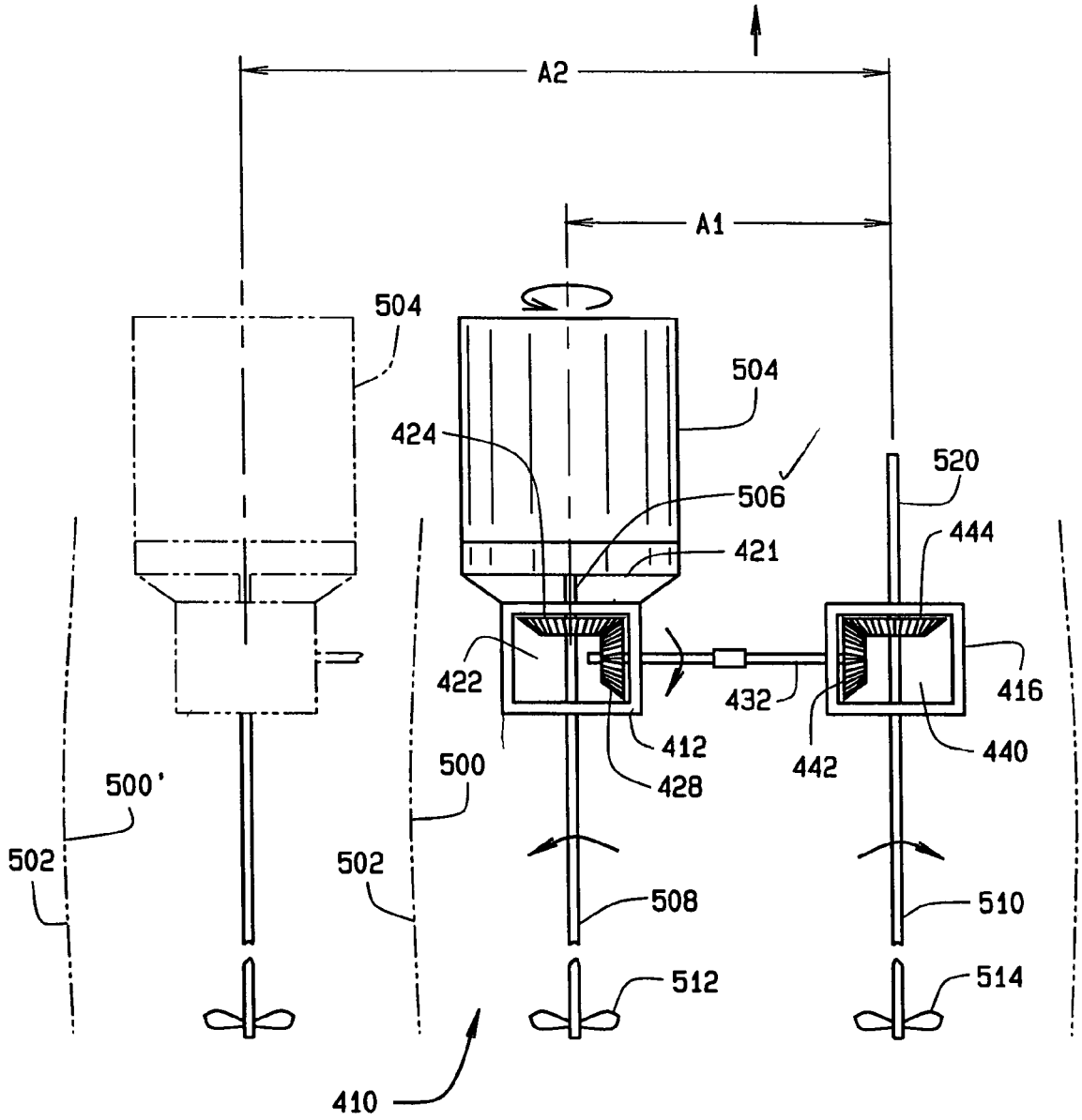
FIG. 21 is a schematic plan view of a single outboard gearbox power boat drive system with the engine on the port side in a forwardly mounted position, showing the wide range of lateral positioning available.
Figure 22:
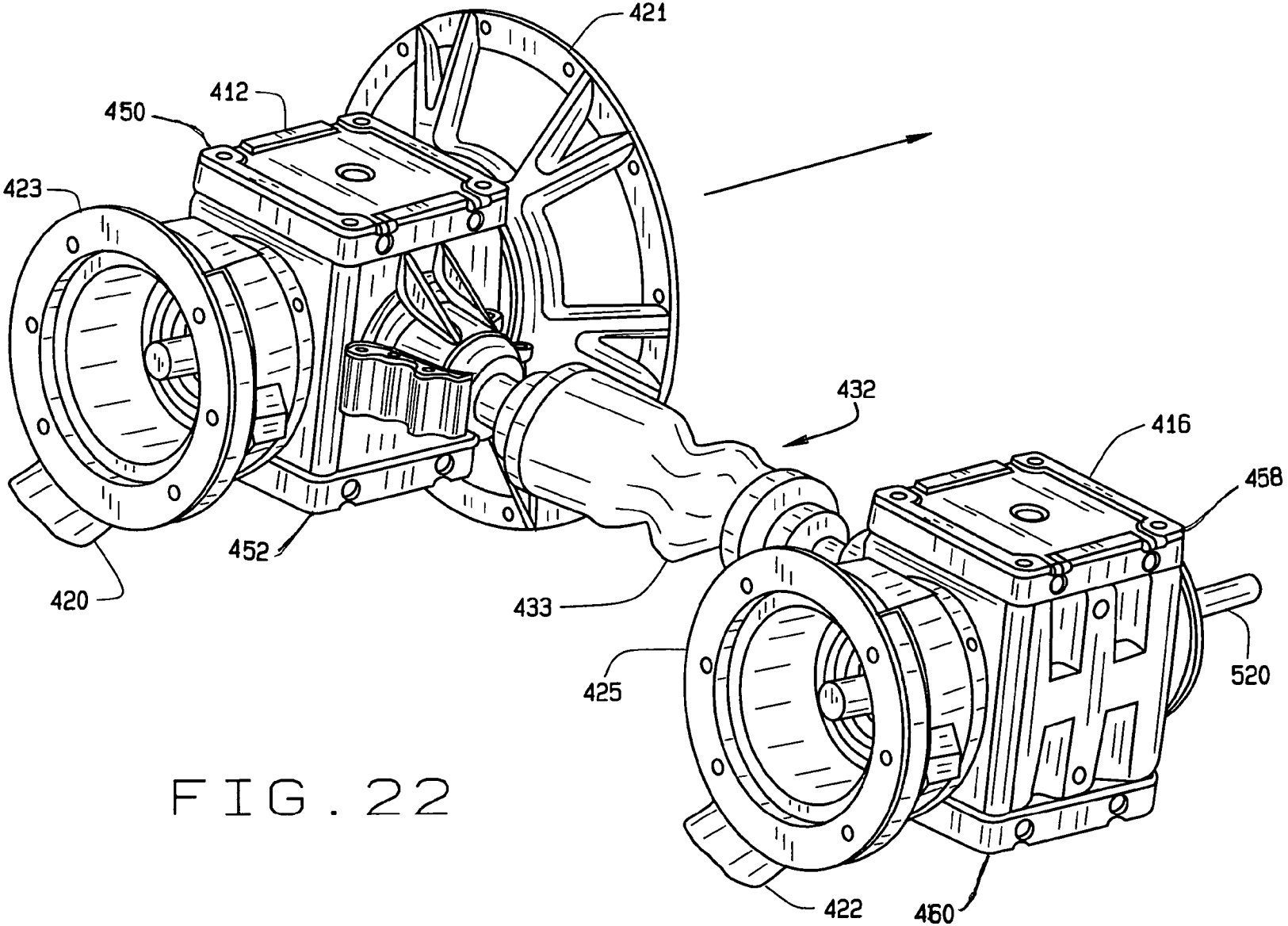
FIG. 22 is a perspective view of the drive system with the engine on the port side taken from side opposite the engine.
Figure 23:
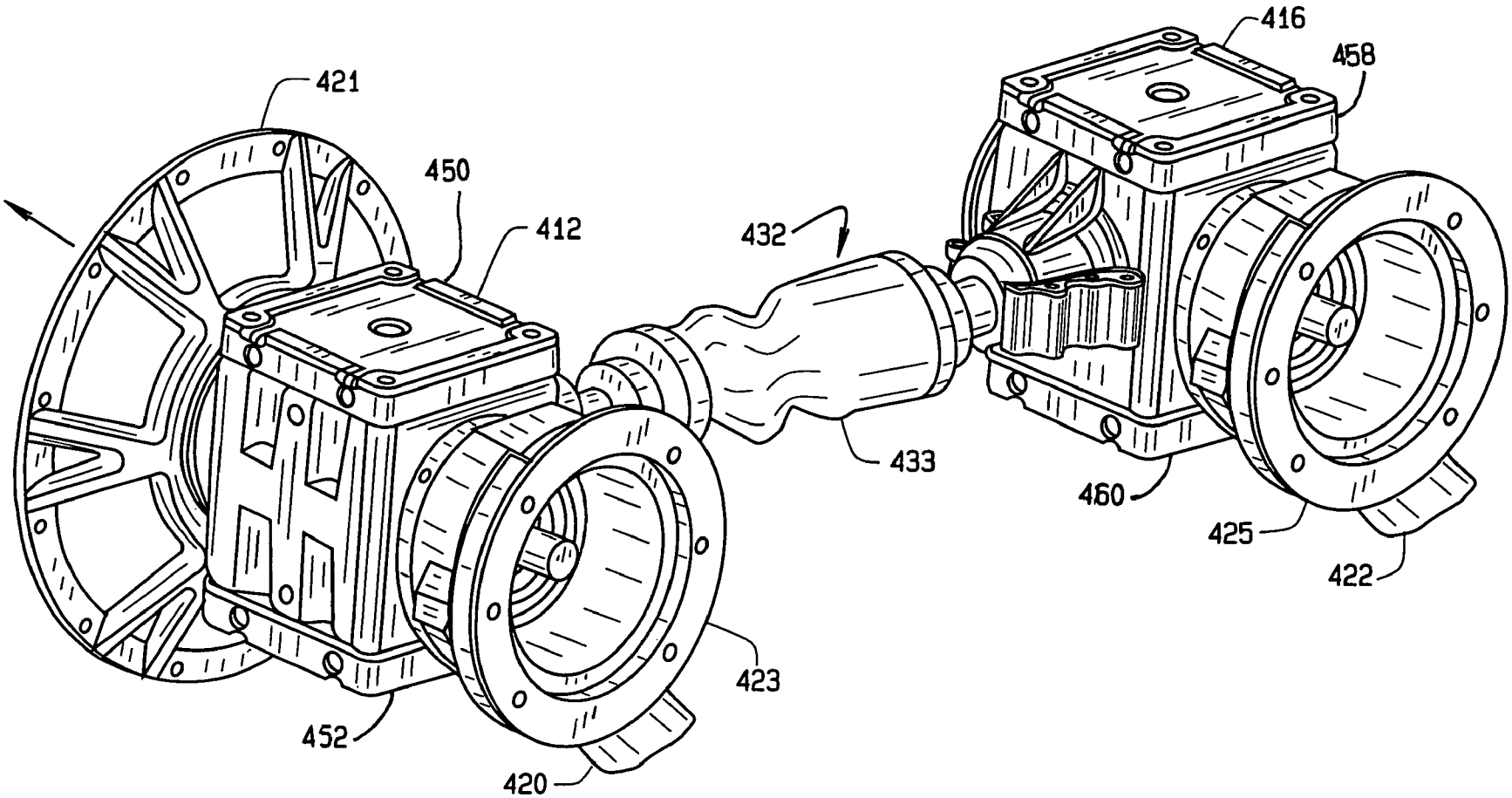
FIG. 23 is a similar perspective view of the drive system taken from side opposite the engine side.

Referring now to the drawing FIGS. 21-23 and first to FIG. 21 it will be understood that a modified drive system, generally indicated by numeral 410, is used for a power boat 500. In the embodiment shown, the power boat 500 includes a hull 502, an engine 504 having a drive shaft 506; and a pair of generally parallel, laterally spaced propeller shafts 508 and 510 having propellers 512 and 514 respectively. FIG. 10 is simplified and does not show, for example, the marine transmissions or adaptors therefore which are shown in FIGS. 22 and 23.

More specifically, the drive system 410, as shown in FIG. 21, includes a primary gearbox 412 and a single outboard gearbox 416. The primary gearbox 412 includes an L-configuration gear arrangement 422 therewithin. The gear arrangement 422 includes a bevel gear 424 attached to the engine drive shaft 506 and a bevel gear 428 attached to an associated transverse shaft 432 extending between the primary gearbox 412 and the outboard gearbox 416. In the embodiment shown an engine adapter plate 421 is provided which facilitates the attachment of the primary gearbox 412 to the engine 504.

The outboard gearbox 416 is on the starboard side only, in the embodiment shown, but alternatively could be on the port side only. The outboard gearbox 416 includes an L-configuration gear arrangement 440 therewithin. The gear arrangement 440 includes a bevel gear 442 attached to the transverse shaft 432 and a bevel gear 444 attached to the propeller shaft 510.

Importantly, the outboard gearbox 416, by virtue of an extension to the propeller shaft 510 can be used to provide a power take-off shaft 520. This power take-off shaft can be use for multiple purposes while the engine is running.

The arrangement of the drive system 410 permits the engine 504 to be optionally disposed forward of the drive system and off centerline of the boat. In addition, the arrangement of the drive system 410 provides that the propeller shafts 508 and 510 can be located much closer together than in the more symmetrical arrangement in which two outboard gearboxes are provided, one on each side of a centrally located engine 504. As discussed above this permits an entire gearbox and associated transverse shaft to be eliminated with a considerable saving in weight and cost.

In addition, and as shown in FIG. 21 in broken outline, the engine 504 and its aligned gearbox 412 can be located closer to the outboard gearbox 416 and propeller shaft 510 to suit a narrow boat 500, or farther apart to suite a broader beam boat indicated by numeral 500'; as demonstrated by the distance between the propeller shafts 508 and 510 indicated by distance A1 or much farther apart as indicated by distance A2.

Figure 24:
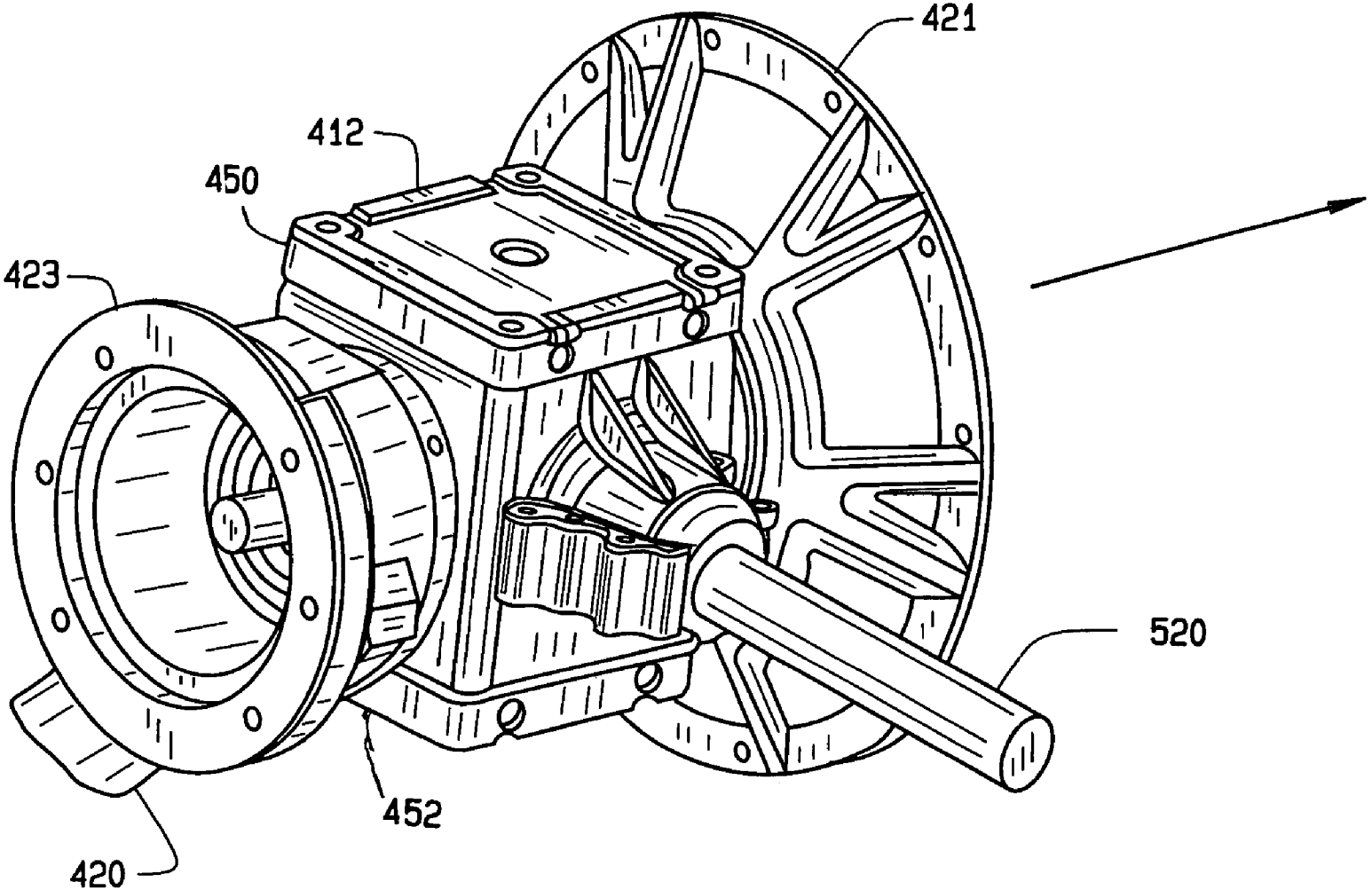
FIG. 24 is a perspective view similar to FIG. 22 but with the starboard gearbox removed and replaced with a take-off shaft.

Another modification is shown in FIG. 24 which is similar to FIG. 22 except that the gearbox 416 is removed and the shaft 432 that normally connects to the outboard gearbox 416 is replaced by shaft 450 and used for a power take off. This arrangement is primarily intended for a single engine single propeller installation only. The output shaft direction of rotation can be changed by turning the gearbox 412 over which changes the direction of rotation of said output shaft.

Figure 27:
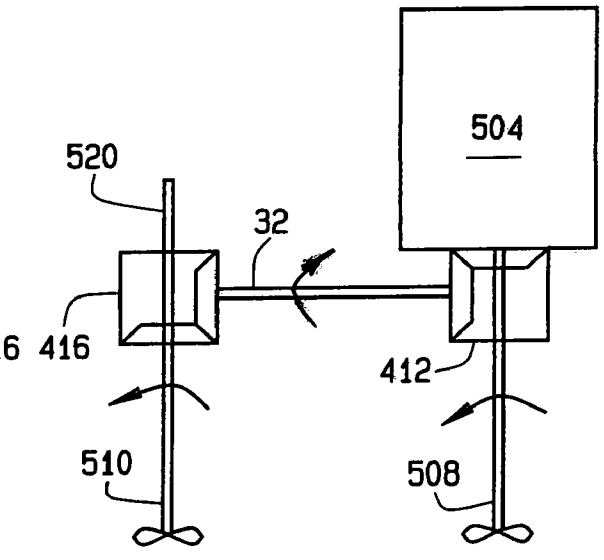
FIGS. 25, 26 and 27 show aspects of different gear arrangements.
Figure 26:
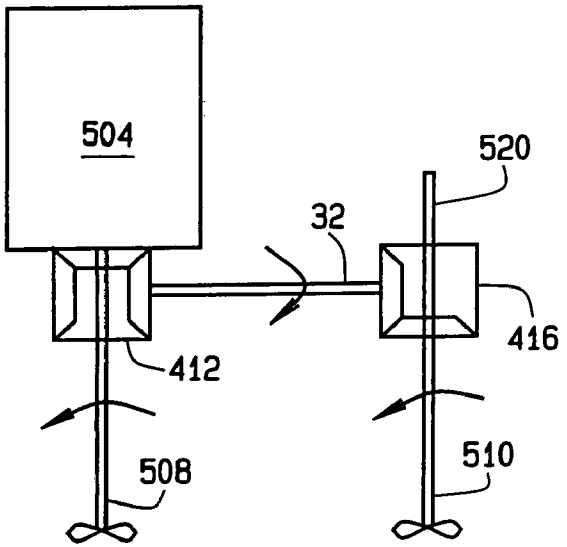
Figure 25:
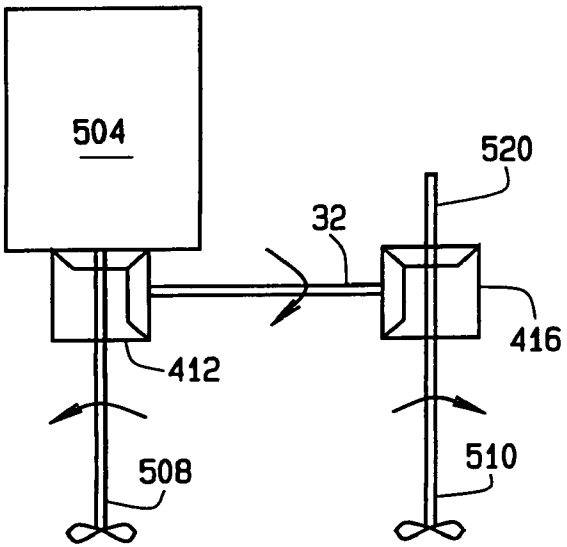

FIGS. 25, 26 and 27 show three different arrangements of the drive system greatly simplified. FIGS. 25 and 26 show the drive with the engine to port and are distinguished by the gear arrangement in the respective port outboard gearbox. FIG. 27 shows the arrangement with the engine 504 to starboard. In each sketch, the rotational direction of the propeller shafts is indicated relative to the direction of rotation of the transverse shaft 432, it being understood that engine shaft rotation is indicated as counterclockwise.

In FIG. 25 the gear arrangement provides that the propeller shafts 508 and 510 are in counter rotation. In FIG. 26 the gear arrangement provides that propeller shafts are 508 and 510 in common rotation. In FIG. 27 a different gear arrangement, with the engine to starboard also provides that the propeller shafts are in common rotation. It will be understood that counter rotation can be achieved by the choice of marine transmission (not shown) disposed between the associated gearbox 416 and propeller shaft 510.

FIGS. 22-24 show the drive system in greater detail and from various aspects. FIG. 22 illustrates that the gearboxes 412 and 416 include upper and lower cooling pads 450 and 452 and 458 and 460 respectively. Gearbox 412 includes engine adapter 421 and marine transmission adapter 423.

Gearbox 416 includes a marine transmission adapter 425 and power take-off shaft 520. FIG. 24 shows a single engine, single gearbox arrangement, in which a shaft 550 replaces the shaft 432 shown in FIG. 22. The single gearbox 412 is similar to that shown in FIG. 8 in that it includes cooling pads.

It will be understood that while the marine transmissions themselves are not shown in detail they are similar, as are the other components mentioned, to those shown in the three gearbox drive system. As will be understood, the drive shaft 432 may include a universal coupling (not shown) to facilitate shaft alignment.

The invention claimed is:

1. A drive system for a boat having a hull, an engine having a drive shaft, a pair of propeller shafts, and means for connecting the engine drive shaft and the propeller shafts, the drive system comprising:

a primary gearbox and an outboard gearbox;

the primary gearbox including a housing and a gear arrangement operatively connected to the engine drive shaft and a first propeller shaft;

the outboard gearbox including a housing and a gear arrangement operatively connected to a second propeller shaft; and a transverse shaft operatively connected between the gear arrangements in the primary gearbox and the outboard gearbox;

each gearbox including an upper cooling pad connected to a respective housing upper wall and a lower cooling pad connected to a respective housing lower wall, the cooling pads being supplied with cooling liquid from the engine to inhibit overheating of the respective gear arrangement within the housings.

2. A drive system as defined in claim 1, wherein the primary gear arrangement is in an L-configuration and the outboard gear arrangement is in an L-configuration whereby the propellers rotate in opposite directions, unless otherwise required by a marine transmission.

3. A drive system as defined in claim 1, wherein a marine transmission is operatively connected to the outboard gearbox.

4. A drive system as defined in claim 3, wherein a support for the transmission includes a cradle associated with the transmission and connected to spaced points on the hull.

5. A drive system as defined in claim 4, wherein each spaced point is provided by a cushioned mounting block, and wherein raised support points are provided in the boat hull to carry each mounting block.

6. A drive system as defined in claim 1, wherein the cooling pads are not machined and a layer of heat sink grease is disposed between each cooling pad and its associated gearbox housing to facilitate heat transfer between the gearbox housing and the cooling pad.

7. A drive system as defined in claim 1, wherein each cooling pad includes a closed chamber having inlet and outlet openings.

8. A drive system as defined in claim 7, wherein: each cooling pad includes upper and lower walls and connecting sidewalls.

9. A drive system as defined in claim 8, wherein the sidewalls provide the inlet and outlet openings.

10. A drive system as defined in claim 8, wherein the upper and lower walls of each cooling pad are connected by a passage providing access to the gearbox housing.

11. A drive system as defined in claim 1, in which a mounting plate is connected between the primary gearbox and the engine to facilitate engine locating.

12. A drive system for a boat having a hull, engine including a drive shaft, a pair of laterally spaced propeller shafts and means for connecting the engine drive shaft and the propeller shafts the drive system comprising:

a primary gearbox and opposed outboard gearboxes;

the primary gearbox including a housing having an upper and lower wall and a gear arrangement within the housing operatively connected to the engine shaft;

each outboard gearbox including a housing having an upper and lower wall and a gearbox arrangement operatively connected to an associate propeller shaft;

each gearbox including an upper cooling pad connected to its associate housing upper wall and a lower cooling pad connected to its associate housing lower wall and supplied with cooling liquid from the engine to inhibit overheating of the gear arrangement within the housing;

the cooling pads being separated from associated gearbox housings and the cooling liquid being water circulated from the engine to the cooling pads to inhibit overheating of the gear arrangement within the gearbox housings.

13. A drive system as defined in claim 12, wherein:

the engine includes an adaptor plate attached to the primary gearbox for movement of the primary gearbox with the engine.

14. A drive system as defined in claim 12, wherein:

a marine transmission is connected to each outboard gearbox and a support for the transmissions includes a cradle associated with each transmission and connected to spaced points on the hull.

15. A drive system as defined in claim 14, wherein:

each spaced point is provided by a cushioned mounting block.

16. A drive system as defined in claim 15, wherein:

raised support points are provided in the boat hull to carry each mounting block.

17. A drive system as defined in claim 12, wherein each cooling pad includes a close chamber having upper and lower walls and connecting sidewalls, and wherein the sidewalls provide inlet and outlet openings.

18. A drive system as defined in claim 17, wherein the upper and lower walls of each cooling pad are connected by a passage providing access to the respective gearbox housing.

19. A drive system for a boat having a hull an engine having a drive shaft, a pair of propeller shafts, and means for connecting the engine drive shaft and the propeller shafts, the drive system comprising:

a primary gearbox and opposed outboard gearboxes;

the primary gearbox including a housing and a gear arrangement operatively connected to the engine shaft;

each outboard gearbox including a housing and a gear arrangement operatively connected to the respective propeller shaft;

each gearbox including an upper cooling pad connected to a respective housing upper wall and a lower cooling pad connected to a respective housing lower wall, the cooling pads being supplied with cooling liquid from the engine to inhibit overheating of the respective gear arrangement within the housings; and a support system for each of the outboard gearboxes including a cradle associated with each outboard gearbox and connected to spaced points on the hull.

* * * * *